US005842241A

United States Patent [19]

Cooper et al.

[11] Patent Number: 5,842,241

[45] Date of Patent: Dec. 1, 1998

[54] WATER JET MASSAGING WATERBED MATTRESS

[76] Inventors: Glen T. Cooper; Victor T. Nelson, both of P.O. Box 711, Lake Stevens, Wash. 98258

[21] Appl. No.: 57,772

[22] Filed: Apr. 9, 1998

[51] Int. Cl.[6] ..... A47C 27/08; A61H 9/00

[52] U.S. Cl. ..... 5/670; 5/933; 5/672; 128/148

[58] Field of Search ..... 5/668, 670, 672, 5/674, 676, 689, 933; 601/148

[56] References Cited

U.S. PATENT DOCUMENTS

| | | | |
|---|---|---|---|
| 4,607,405 | 8/1986 | Ellis et al. | 5/670 |
| 4,635,620 | 1/1987 | Ricchio | 5/670 X |
| 4,684,486 | 8/1987 | Ricchio | 5/670 X |
| 4,713,853 | 12/1987 | Ricchio | 5/670 |
| 4,837,880 | 6/1989 | Coffman | 5/670 |
| 5,016,618 | 5/1991 | Simmons | 128/148 |

*Primary Examiner*—Michael F. Trettel

[57] ABSTRACT

A water jet massaging mattress is provided including a mattress having an interior formed of a soft material and having a solid rectangular configuration. Such interior is defined by a planar top face, a planar bottom face, and a periphery formed therebetween. A water impermeable flexible layer encompasses the interior. A plurality of horn-shaped apertures are formed in the interior of the mattress each with an open top of a first diameter and coincident with the top face of the interior of the mattress. An open bottom of each horn-shaped apertures has a second diameter less than the first diameter and remains coincident with the bottom face of the interior. A jet assembly includes a plurality of jets each situated adjacent the open bottom of an associated one of the horn-shaped apertures. A water pump is situated below the mattress and is connected to a bottom of each of the jets via a plurality of conduits for circulating water through the horn-shaped apertures and against the water impermeable layer.

4 Claims, 2 Drawing Sheets

WATER JET MASSAGING WATERBED MATTRESS

BACKGROUND OF THE INVENTION

1. Field of the Invention

The present invention relates to waterbeds and more particularly pertains to a new jacuzzi waterbed for massaging a back of a user.

2. Description of the Prior Art

The use of waterbeds is known in the prior art. More specifically, waterbeds heretofore devised and utilized are known to consist basically of familiar, expected and obvious structural configurations, notwithstanding the myriad of designs encompassed by the crowded prior art which have been developed for the fulfillment of countless objectives and requirements.

Known prior art waterbeds include U.S. Pat. No. 4,837,880; U.S. Pat. No. 4,635,620; U.S. Pat. No. 4,114,215; U.S. Pat. No. 4,120,062; U.S. Pat. No. Des. 316,939; and U.S. Pat. No. 4,832,094.

In these respects, the jacuzzi waterbed according to the present invention substantially departs from the conventional concepts and designs of the prior art, and in so doing provides an apparatus primarily developed for the purpose of massaging a back of a user.

SUMMARY OF THE INVENTION

In view of the foregoing disadvantages inherent in the known types of waterbeds now present in the prior art, the present invention provides a new jacuzzi waterbed construction wherein the same can be utilized for massaging a back of a user.

The general purpose of the present invention, which will be described subsequently in greater detail, is to provide a new jacuzzi waterbed apparatus and method which has many of the advantages of the waterbeds mentioned heretofore and many novel features that result in a new jacuzzi waterbed which is not anticipated, rendered obvious, suggested, or even implied by any of the prior art waterbeds, either alone or in any combination thereof.

To attain this, the present invention generally comprises a mattress having an interior formed of a soft material and having a solid rectangular configuration. The interior is thus formed with a planar top face, a planar bottom face, and a periphery formed therebetween. The mattress further includes a rigid base plate with a rigid planar configuration. The base plate is coupled to the bottom face of the interior, as shown in FIG. 3. A water impermeable flexible layer is coupled along a perimeter thereof to a periphery of the base plate thereby encompassing the interior.

A plurality of horn-shaped apertures is formed in the interior of the mattress. Each horn-shaped aperture includes an open top of a first diameter. As shown in FIG. 3, the open top remains coincident with the top face of the interior of the mattress. Associated therewith is an open bottom of a second diameter less than the first diameter. The open bottom remains coincident with the bottom face of the interior. It should be noted that a vertical cross-section of an upper periphery of the open top of each horn-shaped aperture defines a portion of a pair of circles. This affords additional comfort to a user resting on the mattress. Next provided is a plurality of circular apertures formed in the base plate of the mattress in concentric relationship with the open bottom of an associated one of the horn-shaped apertures. For reasons that will become apparent hereinafter, each circular apertures has a third diameter less than the second diameter. Finally, a jet assembly is provided including a plurality of jets each coupled within an associated one of the circular apertures of the base plate. Such jets reside adjacent to the jet assembly. A water pump is situated below the rigid plate and is connected to a bottom of each of the jets. This is accomplished by way of a plurality of conduits which circulate water through the horn-shaped apertures and against the water impermeable layer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new jacuzzi waterbed apparatus and method which has many of the advantages of the waterbeds mentioned heretofore and many novel features that result in a new jacuzzi waterbed which is not anticipated, rendered obvious, suggested, or even implied by any of the prior art waterbeds, either alone or in any combination thereof.

It is another object of the present invention to provide a new jacuzzi waterbed which may be easily and efficiently manufactured and marketed.

It is a further object of the present invention to provide a new jacuzzi waterbed which is of a durable and reliable construction.

An even further object of the present invention is to provide a new jacuzzi waterbed which is susceptible of a low cost of manufacture with regard to both materials and labor, and which accordingly is then susceptible of low prices of sale to the consuming public, thereby making such jacuzzi waterbed economically available to the buying public.

Still yet another object of the present invention is to provide a new jacuzzi waterbed which provides in the apparatuses and methods of the prior art some of the advantages thereof, while simultaneously overcoming some of the disadvantages normally associated therewith.

Still another object of the present invention is to provide a new jacuzzi waterbed for massaging a back of a user.

Even still another object of the present invention is to provide a new jacuzzi waterbed that includes a mattress having an interior formed of a soft material and having a solid rectangular configuration. Such interior is defined by a planar top face, a planar bottom face, and a periphery formed therebetween. A water impermeable flexible layer encompasses the interior. A plurality of horn-shaped apertures are formed in the interior of the mattress each with an open top of a first diameter and coincident with the top face of the interior of the mattress. An open bottom of each horn-shaped apertures has a second diameter less than the first diameter and remains coincident with the bottom face of the interior. A jet assembly includes a plurality of jets each situated adjacent the open bottom of an associated one of the horn-shaped apertures. A water pump is situated below the mattress and is connected to a bottom of each of the jets via a plurality of conduits for circulating water through the horn-shaped apertures and against the water impermeable layer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
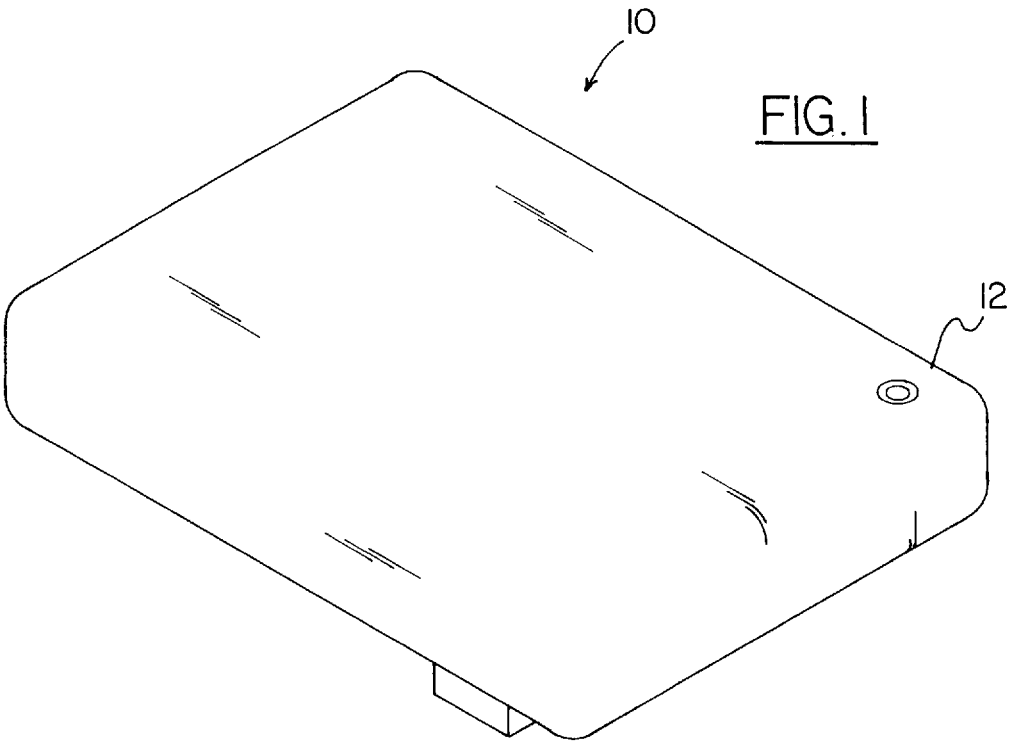
FIG. 1 is a perspective view of a new jacuzzi waterbed according to the present invention.

With reference now to the drawings, and in particular to FIGS. 1 through 4 thereof, a new jacuzzi waterbed embodying the principles and concepts of the present invention and generally designated by the reference numeral 10 will be described.

Figure 3:
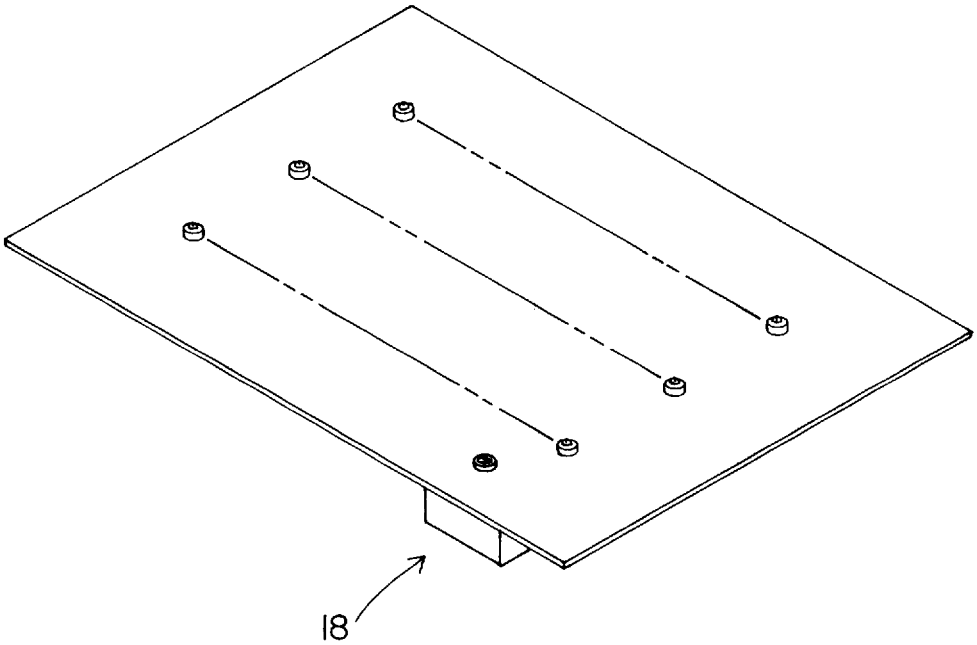
FIG. 3 is a perspective view of the rigid base plate of the present invention.

The system 10 of present invention includes a mattress 12 having an interior formed of a soft material and having a solid rectangular configuration. Such soft material preferably comprises of a resilient foam, elastomeric material, or combination thereof. The interior is thus formed with a planar top face, a planar bottom face, and a periphery formed therebetween. The mattress further includes a rigid base plate with a rigid planar configuration. The base plate is coupled to the bottom face of the interior and has a similar area as compared to interior, as shown in FIG. 3. A water impermeable flexible layer is coupled along a perimeter thereof to a periphery of the base plate thereby encompassing the interior.

Figure 2:
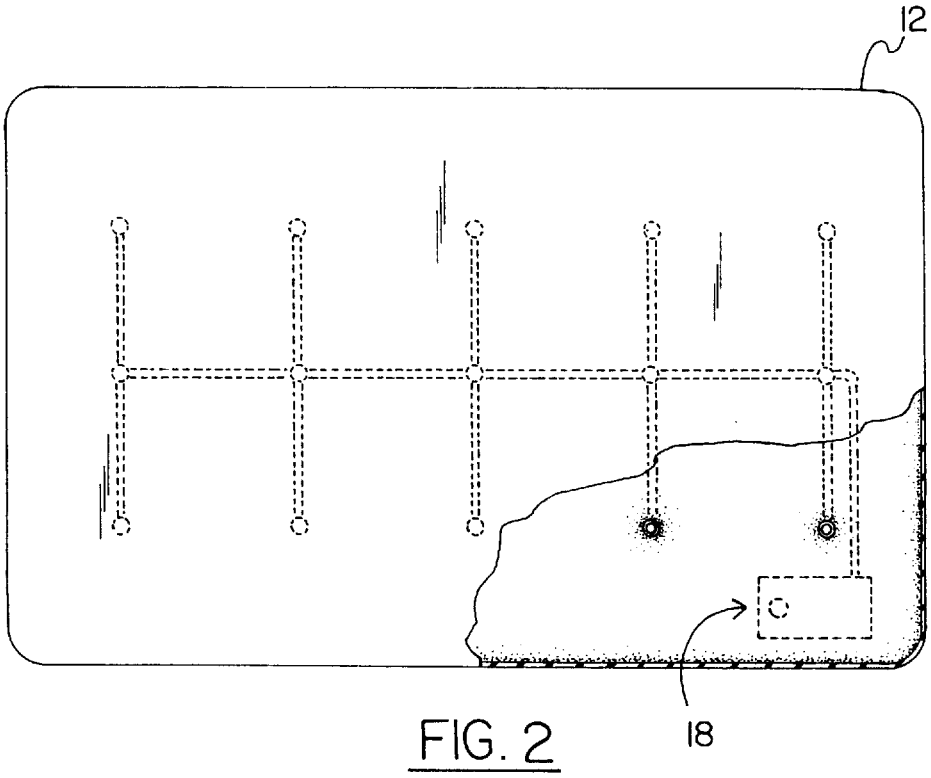
FIG. 2 is a top view of the present invention.

A plurality of horn-shaped apertures 14 is formed in the interior of the mattress. Each horn-shaped aperture includes an open top of a first diameter. As shown in FIG. 3, the open top remains coincident with the top face of the interior of the mattress. Associated therewith is an open bottom of a second diameter less than the first diameter. The open bottom remains coincident with the bottom face of the interior. It should be noted that a vertical cross-section of an upper periphery of the open top of each horn-shaped aperture defines a pair of arcuate surfaces. This affords additional comfort to a user resting on the mattress. As shown in FIG. 2, a matrix of equally spaced horn-shaped apertures are formed in the interior of the mattress.

Next provided is a plurality of circular apertures 16 formed in the base plate of the mattress in concentric relationship with the open bottom of an associated one of the horn-shaped apertures. For reasons that will become apparent hereinafter, each circular apertures has a third diameter less than the second diameter.

Finally, a jet assembly 18 is provided including a plurality of jets each coupled within an associated one of the circular apertures of the base plate. Such jets reside adjacent to the base plate and are clamped to a flange defined by the circular apertures thereof. A pump is situated below the rigid plate and is connected to a bottom of each of the jets.

This is accomplished by way of a plurality of conduits which circulate water through the horn-shaped apertures and against the water impermeable layer. The conduits include a plurality of vertically oriented pipes interconnected via a plurality of perpendicular horizontally oriented pipes. A top of each vertically oriented pipe has an annular lip and is screwably coupled to the associated jet for clamping to the base plate. It should be noted that at least one of the vertically oriented pipes is connected to the pump for purposes of suctioning water from above the interior in order to dispense the same again through the jets.

Figure 4:
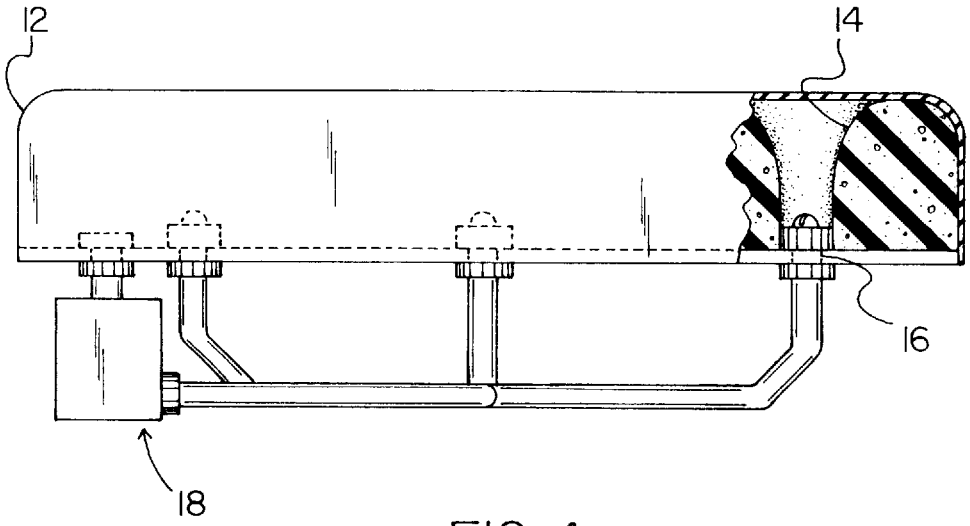
FIG. 4 is a cross-sectional view of the present invention.

As an option, bumps may be situated on the top surface of the mattress for preventing the aforementioned suctioning from creating a seal between the water impermeable layer and interior. As shown in FIG. 1, the top of the water impermeable layer is equipped with a topped aperture for allowing access thereto. As shown in FIG. 4, the water impermeable layer is wrapped tightly about the mattress. During use, the flexibility of the interior and water impermeable layer permits a layer of water to form therebetween.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water jet massaging mattress comprising, in combination:

a mattress including an interior formed of a soft material and having a solid rectangular configuration with a planar top face, a planar bottom face, and a periphery formed therebetween, the mattress further including a rigid base plate with a rigid planar configuration coupled to the bottom face of the interior and a water impermeable flexible layer coupled along a perimeter thereof to a periphery of the base plate thereby encompassing the interior;

a plurality of horn-shaped apertures formed in the interior of the mattress each with an open top of a first diameter and coincident with the top face of the interior of the mattress and an open bottom of a second diameter less than the first diameter and coincident with the bottom face of the interior, wherein a vertical cross-section of an upper periphery of the open top of each horn-shaped aperture defines a portion of a pair of circles thereby affording additional comfort;

a plurality of circular apertures formed in the base plate of the mattress in concentric relationship with the open bottom of an associated one of the horn-shaped apertures, wherein each circular apertures has a third diameter less than the second diameter; and a jet assembly including a plurality of jets each coupled within an associated one of the circular apertures of the base plate and remaining adjacent thereto and a water pump situated below the rigid plate and connected to a bottom of each of the jets via a plurality of conduits for circulating water through the horn-shaped apertures and against the water impermeable layer.

2. A water jet massaging mattress comprising:

a mattress including an interior formed of a soft material and having a solid rectangular configuration with a planar top face, a planar bottom face, and a periphery formed therebetween and a water impermeable flexible layer coupled encompassing the interior;

a plurality of horn-shaped apertures formed in the interior of the mattress each with an open top of a first diameter and coincident with the top face of the interior of the mattress and an open bottom of a second diameter less than the first diameter and coincident with the bottom face of the interior; and a jet assembly including a plurality of jets each situated adjacent the open bottom of an associated one of the horn-shaped apertures and a water pump situated below the mattress and connected to a bottom of each of the jets via a plurality of conduits for circulating water through the horn-shaped apertures and against the water impermeable layer.

3. A water jet massaging mattress as set forth in claim 2 wherein a vertical cross-section of an upper periphery of the open top of each horn-shaped aperture defines a portion of a pair of circles thereby affording additional comfort.

4. A water jet massaging mattress as set forth in claim 2 wherein the jets are mounted to a rigid plate which is situated below the mattress.

* * * * *